United States Patent [19]

Harband

[11] Patent Number: 4,474,021

[45] Date of Patent: Oct. 2, 1984

[54] HEAT PUMP APPARATUS AND METHOD

[76] Inventor: Joel Harband, Rehov Hibner 13/6, Petach Tikva, Israel

[21] Appl. No.: 460,882

[22] Filed: Jan. 25, 1983

[30] Foreign Application Priority Data

Feb. 2, 1982 [IL] Israel ..... 64915

[51] Int. Cl.[3] ..... F25D 17/06

[52] U.S. Cl. ..... 62/94; 62/271; 62/412

[58] Field of Search ..... 62/93, 94, 271, 412

[56] References Cited

U.S. PATENT DOCUMENTS

| | | | |
|---|---|---|---|
| 2,672,024 | 3/1954 | McGrath | 62/94 |
| 2,946,201 | 7/1960 | Munters | 62/271 |
| 3,009,331 | 11/1961 | Hewett et al. | 62/94 |
| 4,180,985 | 1/1980 | Northrup, Jr. | 62/94 |
| 4,244,193 | 11/1981 | Haakenson | 62/412 |
| 4,259,849 | 4/1981 | Griffiths | 62/94 |

*Primary Examiner*—Ronald C. Capossela
*Attorney, Agent, or Firm*—Browdy and Neimark

[57] ABSTRACT

A temperature and humidity control system including a heat pump including a compressor, an evaporator and a condenser; vaporizable refrigerant contained in a closed circuit communicating with the compressor, evaporator and condenser, a regeneratable dessicant material, valve and conduit apparatus for selectably directing air into and communicating with the condenser, evaporator and dessicant material and including first apparatus operable in a cooling/dehumidifying mode for supplying air first to the evaporator and from the evaporator to the dessicant material, and from the dessicant material to a volume sought to be conditioned and second apparatus operable in a heating/humidifying mode for supplying air first to the condenser for heating of the air and from the condenser to the dessicant material for humidifying of the air to a volume sought to be conditioned.

6 Claims, 7 Drawing Figures

HEAT PUMP APPARATUS AND METHOD

FIELD OF THE INVENTION

The present invention relates to air conditioning and heat pump apparatus generally and more particularly to apparatus of this type employing a regeneratable dessicant material for providing desired humidity control.

BACKGROUND OF THE INVENTION

The use of air-to-air heat pumps is extremely widespread in the field of comfort air conditioning. Heat pumps of this type are used to cool and dehumidify in summer and to heat in winter on the basis of a conventional vapor compression cycle. The shift between cooling and heating modes is effected by reversing the direction of refrigerant flow and correspondingly interchanging the roles of condenser and evaporator in the cycle.

Heat pumps of the type described hereinabove have a number of significant limitations. Firstly, the comfort levels provided thereby sometimes fall significantly below desired levels. Secondly a relatively high level of electricity consumption is required in view of the comfort level provided.

These limitations have a number of aspects. In humid summer weather, it is normally not economically feasible to maintain the conditioned volume at a relative humidity of less than approximately 50%. Conventional apparatus does not provide further dehumidification which would increase the comfort level for the same room temperature or alternatively allow a reduction in electricity consumption by permitting an increase in the room temperature while maintaining the same comfort level.

Concomitantly, in winter weather conventional heat pump apparatus does not provide humidification which would increase the comfort level for the same room temperature or alternatively allow a reduction in electricity consumption by permitting a decrease in the room temperature while maintaining the same comfort level.

It is known to provide apparatus separate from the heat pump for humidifying or dehumidifying. Such apparatus is normally less efficient that the heat pump itself, requires a separate water connection and involves periodic maintenance.

An additional difficulty arises from frosting of the evaporator coils of conventional heat pumps in the winter. This may occur whenever moisture condenses on the coil at freezing temperatures. Conventional heat pumps which are provided with defrosting apparatus must disable their normal functioning during the operation of the defrosting apparatus and require additional energy for the defrost function.

It may be appreciated that the operation of conventional heat pumps in the summer and the winter involves the wastage of a moisture transfer potential due to the significant difference between the relative humidity of the air streams exiting at the evaporator and the condensers.

U.S. Pat. No. 4,180,985 describes a method and apparatus for summer cooling and dehumidification wherein a vapor compression refrigeration system is equipped with a regeneratable dessicant for contacting moist feed air prior to passing the feed air across the evaporator coils of the system. The dessicant removes moisture from the feed air thereby improving the efficiency of the air conditioning system. The dessicant material is regenerated by utilizing waste heat which is removed from the condenser of the air conditioning system.

The teaching of U.S. Pat. No. 4,180,985 involves a number of difficulties. Firstly, the adsorption capacity of the dessicant is relatively low due to the limited amount of regeneration which can be provided by the relatively low temperature of the air stream at the condenser output. Thus, the relative humidity of the air supplied to the air conditioned room by the apparatus may not be significantly less than that produced by conventional apparatus not incorporating the dessicant, thereby involving the drawbacks already discussed above.

Concomitantly, the apparatus of U.S. Pat. No. 4,180,985 cannot be used for simultaneous heating and humidifying because the cool feed air entering the dessicant is of too high a relative humidity to pick up any appreciable moisture.

No solution is proposed to the problem of frosting.

U.S. Pat. No. 4,259,849 describes a chemical dehumidification system which utilizes a refrigeration unit for supplying energy to the system and in which air passes first through a dehumidifier unit prior to passing an evaporator. A corresponding heating system is not provided.

U.S. Pat. No. 2,946,201 proposes the use of a regeneratable dessicant to dehumidify freezer room air in order to avoid frosting of cooling coils.

U.S. Pat. No. 2,138,689 illustrates the use of a dessicant for humidification.

SUMMARY OF THE INVENTION

The present invention seeks to overcome disadvantages of the prior art apparatus described above and to provide heat pump apparatus characterized by high efficiency operation in various modes of operation.

There is thus provided in accordance with a preferred embodiment of the present invention a temperature and humidity control system including a heat pump including a compressor, an evaporator and a condenser; vaporizable refrigerant contained in a closed circuit communicating with the compressor, evaporator and condenser, a regeneratable dessicant material, valve and conduit apparatus for selectably directing air into and communicating with the condenser, evaporator and dessicant material and including first apparatus operable in a cooling/dehumidifying mode for supplying air first to the evaporator and from the evaporator to the dessicant material, and from the dessicant material to a volume sought to be conditioned and second apparatus operable in a heating/humidifying mode for supplying air first to the condenser for heating of the air and from the condenser to the dessicant material for humidifying of the air to a volume sought to be conditioned.

Additionally in accordance with an embodiment of the present invention the second apparatus is also operable in a heating/humidifying/frost avoidance mode wherein the cooling of high relative humidity air at a first portion of the evaporator is limited so as to reduce the condensation at the remainder of the evaporator coils and consequent frosting thereof under freezing conditions. In this embodiment, according to a preferred form thereof collection of condensate on a first portion of the evaporator is encouraged for reducing the heat transfer thereat and thus the cooling of the air passing therethrough. This air passes through the dessicant material where it is dried and heated to above ambient temperature and is then mixed with ambient air, reducing the overall relative humidity of the mixture which passes the remainder of the evaporator coils, thereby reducing frosting thereof.

In accordance with the present invention, the dessicant material is preferably arranged in a disk which is rotated into sequential engagement with the air streams at both the evaporator and the condenser for humidity exchange therebetween.

Further in accordance with an embodiment of the present invention apparatus may be provided for rotating the dessicant material in communication with evaporator and condenser air flows at a relatively high speed, thereby providing heat transfer from the condenser air flow to the evaporator air flow. This provides a reheat function to supply air after it has passed through the cooling coils enabling desired dehumidification without excessive cooling in a situation of high latent and low sensible loads. This feature employs control of the compressor by a humidistat as is the practice in ordinary stand-alone household dehumidifying devices. This enables a desired humidity level to be maintained without lowering the temperature outside of the comfort region and wasting energy in unnecessary cooling.

Additionally in accordance with an embodiment of the invention there is provided a method for providing temperature and humidity control to a volume comprising cooling/dehumidifying mode operation including the step of feeding warm moist air first to the evaporator coil of a heating pump, thence to a dessicant material and thence to the volume sought to be conditioned, and heating/humidifying mode operation including the step of supplying air first to the condenser for heating of the air, and from the condenser to the dessicant material for humidifying of the air and thence to a volume sought to be conditioned.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
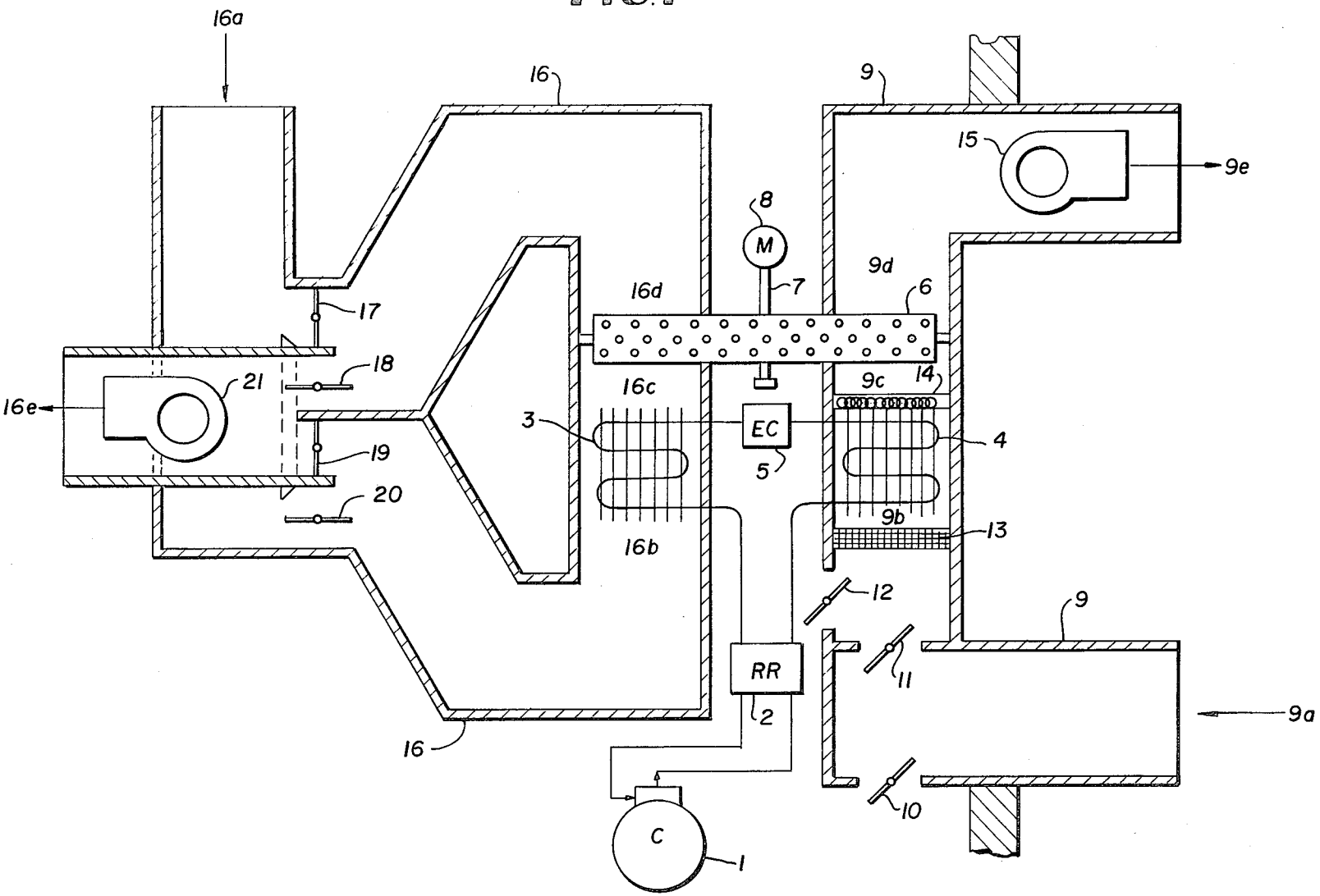
FIG. 1 is a schematic illustration of heat pump apparatus constructed and operative in accordance with a preferred embodiment of the present invention.

Reference is now made to FIG. 1 which illustrates improved heat pump apparatus constructed and operative in accordance with an embodiment of the present invention and comprising conventional heat pump components including a compressor 1, refrigerant switching valves 2, coils 3 and 4 which serve alternatively as condenser and evaporator, and a system of check valves and expansion valves indicated generally at reference numeral 5.

A regeneratable dessicant 6, such as silica gel, is formed to have an overall disk like shape and is arranged for rotation about a shaft 7 powered by a motor 8. A return duct 9 receives return air from a conditioned space in a direction indicated by an arrow 9*a*. An exhaust damper 10, a return air damper 11 and an outside air damper 12 are assoicated with duct 9 as illustrated, enabling the return air together with outside air, as desired, to pass via an air filter 13 into engagement with coil 4. Downstream of coil 4 there may be provided a supplementary heater 14.

Further downstream of coil 4 is a portion of dessicant 6, which is noted above, is maintained in rotational motion about shaft 7. Downstream of dessicant 6 there is provided a supplementary blower 15, which assists the output air flow from duct 9 at location 9*e*.

An outside air duct 16 receives outside air entering in a direction 16*a* and provides via inlet dampers 17 and 20 and outlet dampers 18 and 19 a selectably controlled circulation path via dessicant 6, which as noted above, also circulates in communication with the return air path, via coil 3 to an outside air outlet 22 which is provided with an exhaust fan 21, for exhaust at location 16*e*.

When the system is in normal operation, return air from the conditioned space enters at location 9*a*, at a state 9*a*. Part of it exhausts via damper 10 and an equivalent amount of outside fresh air enters via damper 12 and mixes with the return air stream. The mixed air passes through filter 13, exchanges heat with coil 4, exchanges moisture with dessicant 6 and is supplied to the conditioned volume by blower 15.

Outside air enters duct 16 at location 16*a* and at state 16*a*. The direction of air flow past dessicant 6 and coil 3 is determined by the setting of dampers 17–20. when dampers 17 and 19 are closed and dampers 18 and 20 are open, as illustrated in the drawing, the outside air first contacts coil 3 and then contacts the dessicant. When dampers 17 and 19 are open and dampers 18 and 20 are closed, the outside air first contacts the dessicant 6 and then contacts coil 3.

It is a particular feature of the present invention that three different modes of operation are selectably provided. These are cooling/dehumidifying, heating-/humidifying and heating/humidifying/frost avoidance. In describing these modes reference will be made to the psychorometric charts appearing in FIGS. 2, 3 and 4. In each of these figures, the numbered points on the charts refer to psychrometric states at locations in the apparatus illustrated in FIG. 1, bearing the same numbers.

Figure 2:
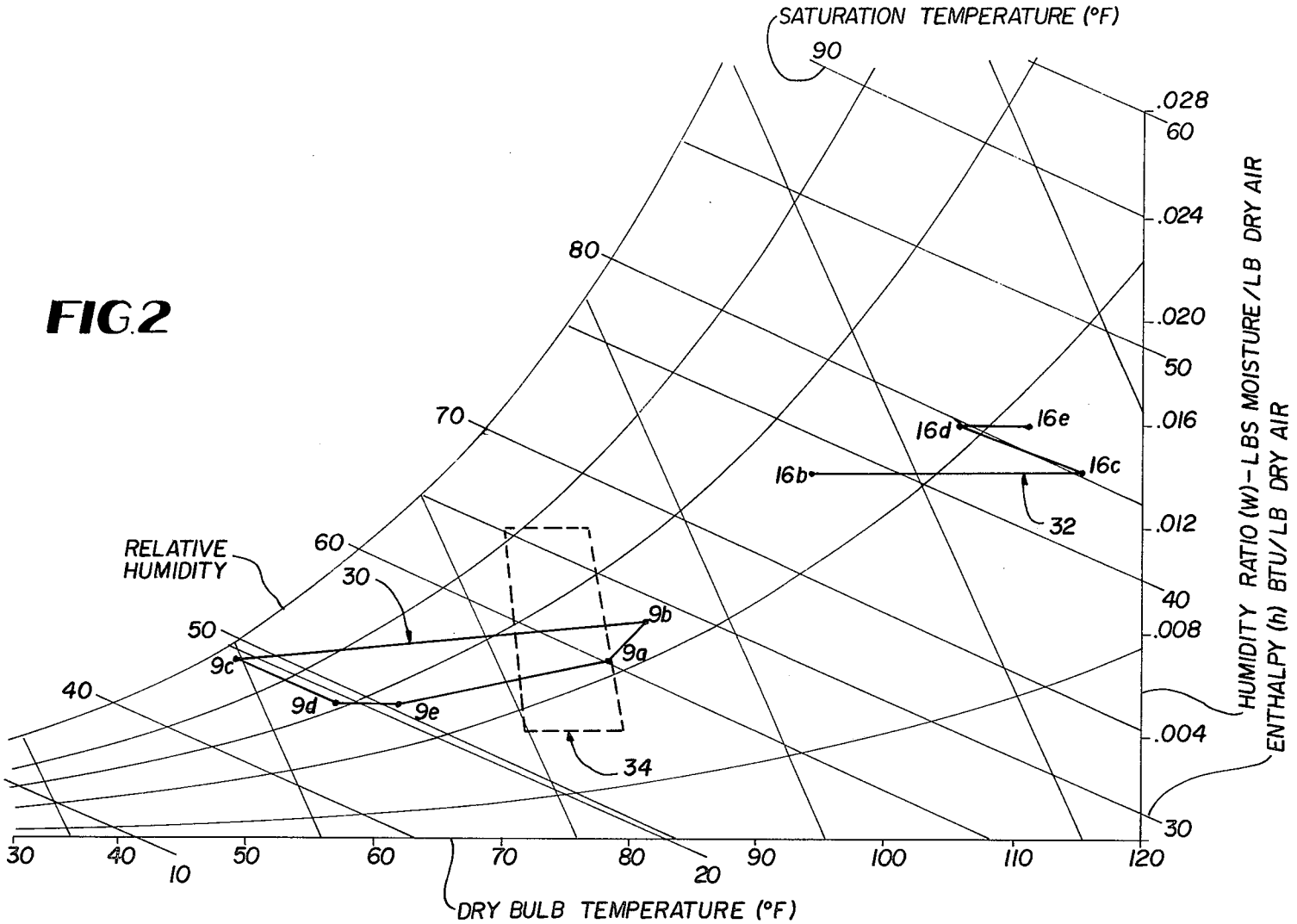
FIGS. 2, 3 and 4 are Psychrometric Charts produced by the American Society of Heating, Refrigerating and Air-Conditioning Engineers, Inc. which are marked to illustrate operation of the apparatus of FIG. 1 in various modes of operation.

Considering the cooling/dehumidifying mode, reference is made to FIG. 2. The lower left polygon 30 illustrated on the psychrometric chart corresponds to the room air circuit through conduit 9, while the upper right figure corresponds to the outside air circuit through conduit 16. A polygon 34 defined by dashed lined defines the ASHRAE comfort region as defined in the ASHRAE Handbook, 1981, Fundamentals 8.21.

Returning room air at location 9*a* is mixed with fresh outside air at location 16*b* to provide hot moist air at location 9*b*. As the air passes through the cooling coil 4, its temperature is reduced to approximately 50 degrees F. and the air is partially dehumidified, reaching state 9*c* at location 9*c* in the apparatus. Upon passing through the dessicant, the air is further dehumidified and gains sensible heat, thereby reaching state 9*d* at that corresponding location. The air gains further sensible heat from blower 15 and is supplied to the room at state 9*e*.

The air supplied to the room, hereinafter termed, "supply air" has an absolute humidity of approximately 0.002 lb/lb, less than supply air provided by a conventional air conditioner. In circulating through the room, the supply air picks up heat and moisture and returns to state 9*a*.

In cooling/dehumidifying mode operation, dampers 17 and 19 are closed and dampers 18 and 20 are open. Entering outside air at 16*b* is heated first by coil 3 and reaches state and location 16*c*. It then picks up moisture from the dessicant 6 and gives up sensible heat, reaching state 16*d*. This air picks up further heat from blower 21 and reaches state 16*e* as it is exhausted.

It is known that an increase in room temperature can be compensated for in terms of comfort by a correspondingly lower relative humidity. A rise of one degree F. can be compensated by a reduction in relative humidity of about 10%. It may be seen that the present invention enables the maintenance of relative humidity of about 30–35% instead of a conventional level of 50%. It follows that the room temperature may be raised by several degrees without sacrificing comfort. This enables reduction of the room sensible load due to the reduced difference between room and outside temperatures and reduces overall and peak load electricity consumption.

In view of the reduction in sensible load, the difference between the supply temperature at 9*e* and the room temperature at 9*a* is reduced from the conventional 20 degrees F. to 16 degrees F., while maintaining the same air flow rate.

Figure 3:
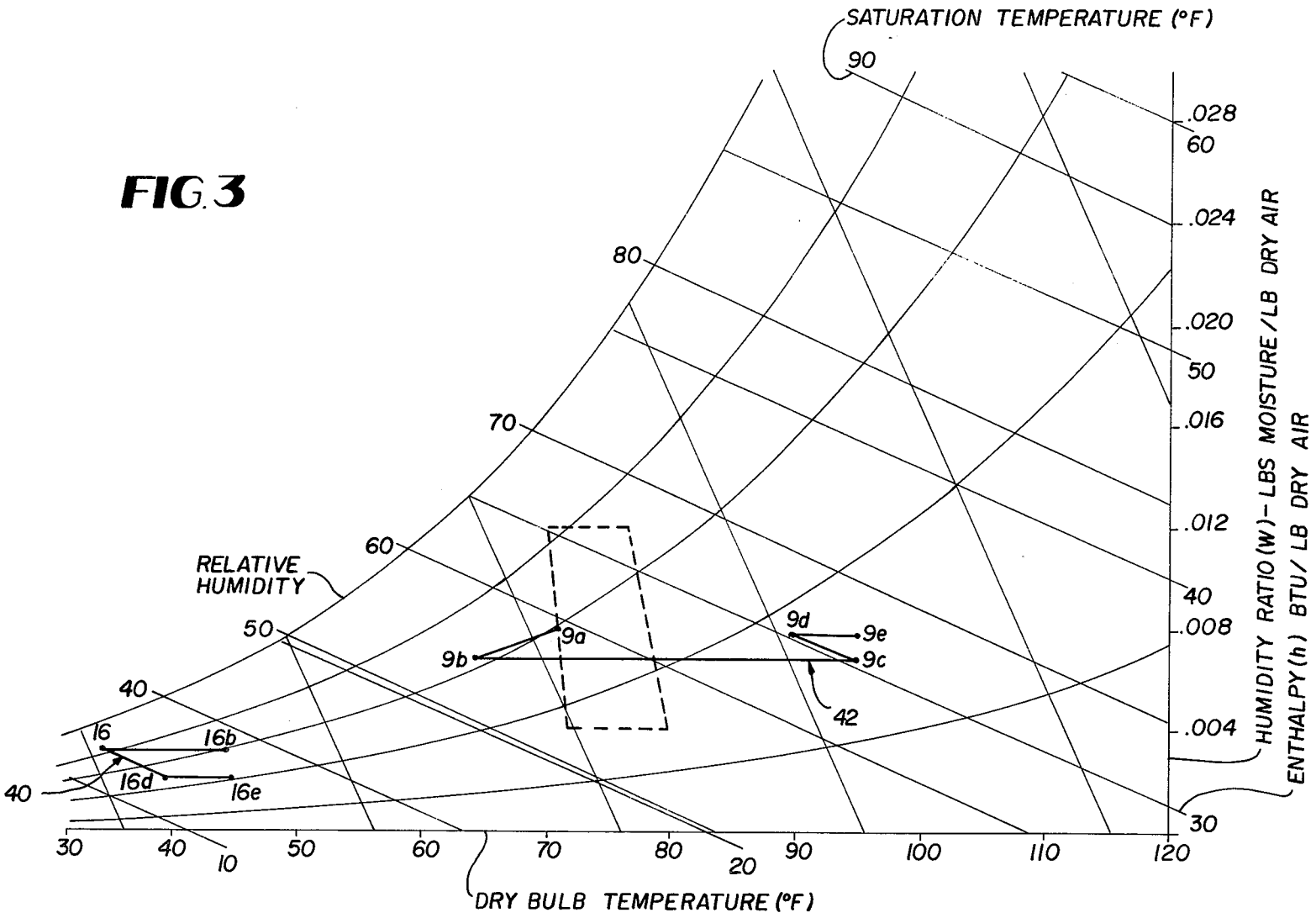

Reference is now made to FIG. 3 which illustrates operation of the apparatus in the heating/humidifying mode. Here, the lower left figure 40 is the outside air circuit and the upper right figure 42 is the room air circuit Room air entering at 9*a* is mixed with cold outside air entering at damper 12 to provide a mixture of air at a state 9*b*. The mixed air is heated by coil 4 and optionally by heater 14 to state 9*c*. The air then passes through dessicant 6 where it picks up moisture and gives up heat, reaching state 9*d*. The blower adds heat to the air and supplies it to the room at state 9*e*. In circulating through the room, the air gives up heat and reaches room condition 9*a*.

Considering the outside air circuit, the dampers 17 and 19 are closed and dampers 18 and 20 are opened. Outside air enters at location and state 16*b* and is cooled by coil 3 to state 16*c*. It then gives up moisture to the dessicant and picks up heat, reaching state 16*d*. The air is then exchausted by the blower 21 at state 16*e*.

The foregoing example of operation in the heating/humidifying mode illustrates another important feature of the present invention, that the humidification step brings the room condition into the comfort region. In conventional heat pump, the absolute humidity in the room reaches equilibrium with the outside condition 16*b* producing a relative humidity of 15–20% in the room, outside the comfort region. The apparatus of the present invention provides 50% relative humidity in the room, which is sufficient to even compensate for lower room temperatures without going outside the comfort region. The result is savings in overall and peak electricity consumption.

Figure 4:
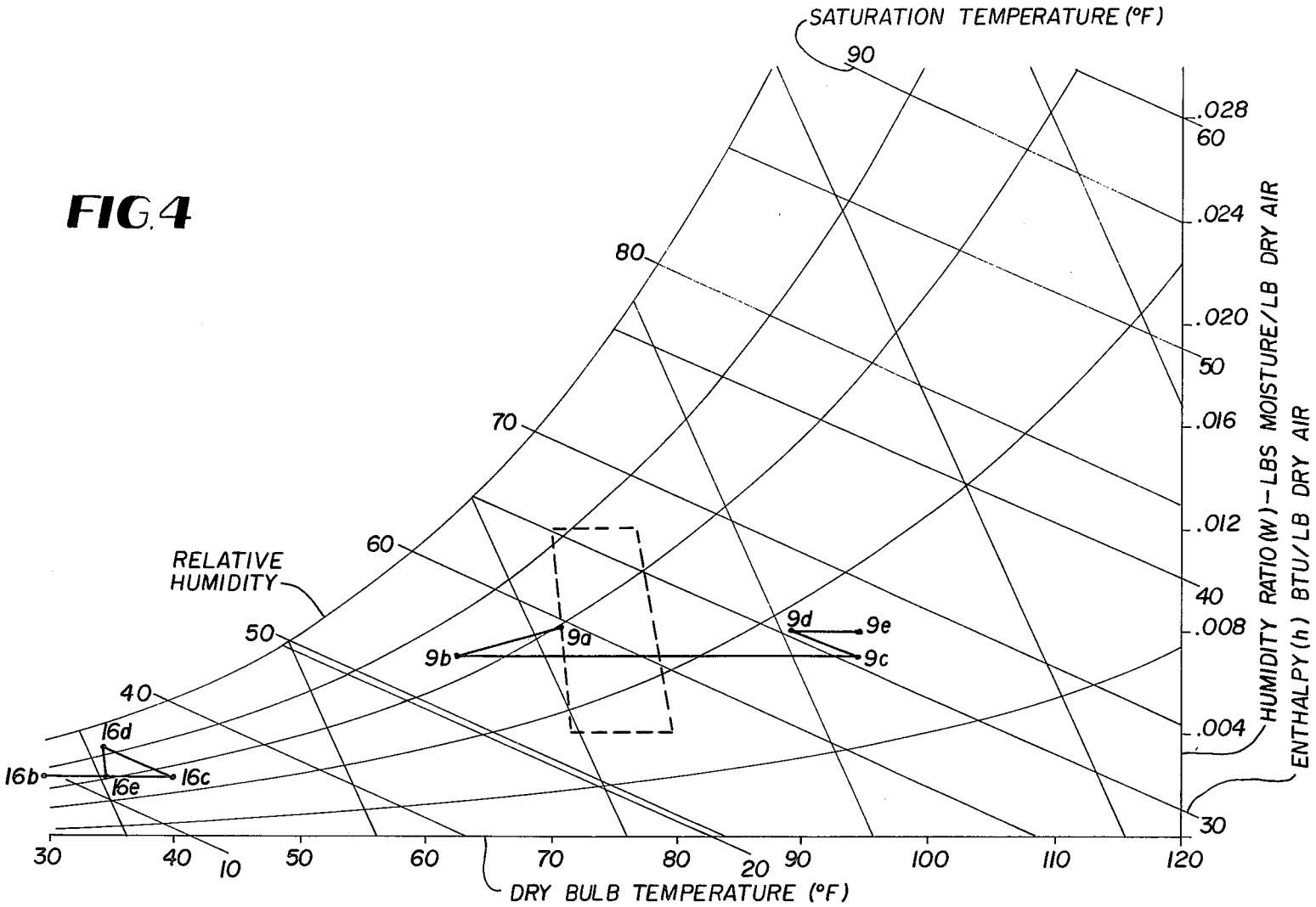

Reference is now made to FIG. 4 which illustrates operation of the apparatus of FIG. 1 in the heating/humidifying/frost-avoidance mode. The room air circuit is similar to that described in connection with FIG. 4 and will not be described hereinabove for reasons of conciseness. In the outside air circuit, dampers 17 and 19 are open and dampers 18 and 20 are closed. The outside air enters at location 16*d*, first contacting the dessicant 6 where it gives up moisture and picks up heat so as to reach state 16*c* at location 16*c*. It then passes the evaporator coil 3, giving up heat and reaching state 16*b*. This air is then exhausted by blower 21 at state 16*e*. In this process, the moist air does not reach saturation, so that frosting is avoided.

In considering the efficiencies of the various modes of operation of the apparatus of FIG. 1 in connection with the invention, it is noted that the efficiency of a vapor compression system is proportional to the difference between condensing and evaporating temperatures.

The efficiency of operation in the cooling/dehumidifying mode is approximately equal to that of a conventional heat pump. The efficiency of operation in the heating/humidifying mode is approximately 10% less efficient than the heating mode of a conventional heat pump. This loss of efficiency can be offset, however, by reducing the room temperature without loss of comfort due to the increased room humidity as described hereinabove.

In any event, the humidification provided in this mode is of higher efficiency than that provided by a conventional humidifier, since the humidifying energy is provided with the efficiency of the heat pump.

The heating/humidifying/frost-avoidance mode has an efficiency equal to that of a conventional heat pump since the evaporator temperature is raised by the same amount as the condensing temperature is raised to offset the cooling effect of the dessicant from state 9*c* to state 9*d*, assuming equal inside and outside air flows. It is thus appreciated that the humidification is provided substantially energy free. Further, if the room temperature is reduced without reducing comfort in view of the increase in humidity provided by the present invention, enhanced efficiency as compared with a conventional heat pump is realized.

Figure 5:
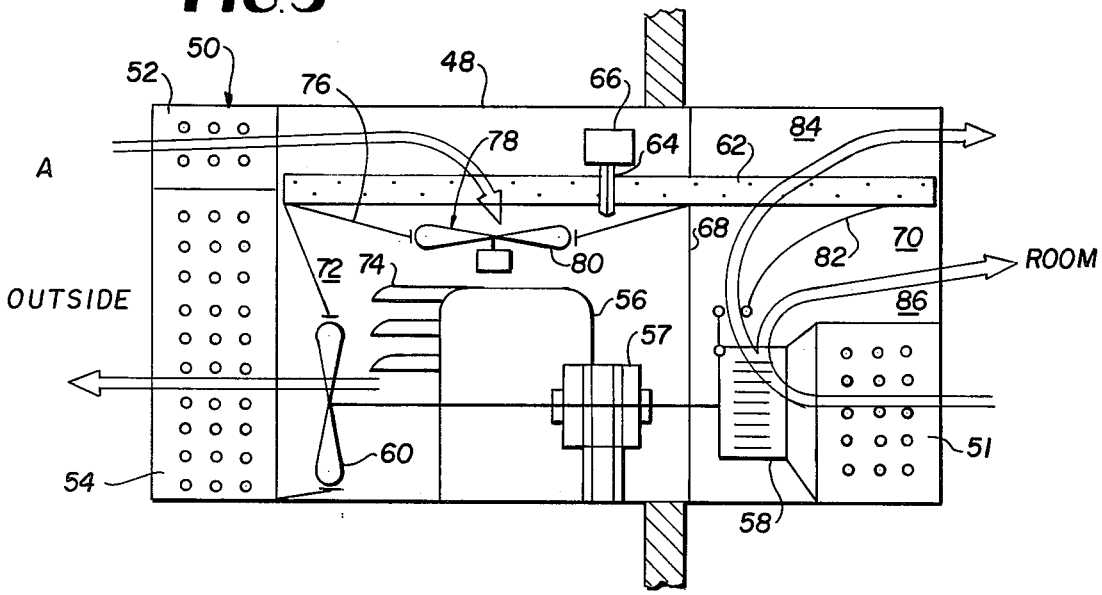
FIG. 5 is a schematic illustration of heat pump apparatus constructed and operative in accordance with an alternative embodiment of the invention.
Figure 6:
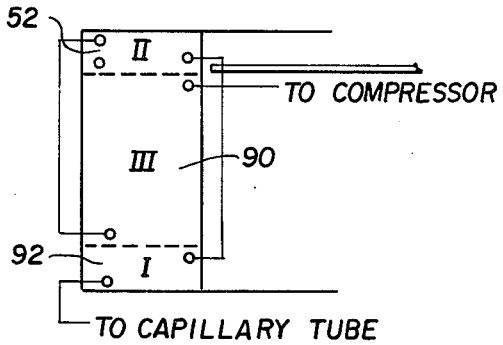
FIG. 6 is an illustration of the outside coil refrigerant circuit connections in accordance with the embodiment of FIG. 5.
Figure 7:
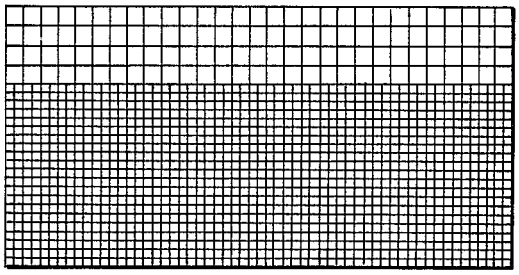
FIG. 7 is an illustration of the coil fin arrangements employed in the embodiment of FIG. 5.

Reference is now made to FIGS. 5, 6 and 7 which illustrate an alternative embodiment of the present invention embodied in a room air conditioner. The room air conditioner of FIG. 5 comprises a housing 48 including a two part outside coil 50 and an inside coil 51. The two part outside coil 50 includes a relatively smaller top portion 52 and a relatively larger lower portion 54 connected in series with the top part 52. The outside and inside coils 50 and 51 are interconnected by conventional refrigerant circuitry and valves with a compressor 56, also of conventional construction. A motor 57 drives a blower 58 which draws return air from a room volume through the inside coil 51 and a fan 60 which forces air outwardly through the lower part 54 of the outside coil 50.

A disk 62 of dessicant material, such as silica gel, is mounted for rotation about a shaft 64 which in turn is driven in rotary motion by a motor 66. A partition 68 separates housing 48 into a room air chamber 70 and an outside air chamber 72. Disk 62 traverses partition 68 so as to revolve the surface area of the dessicant disk 62 sequentially from the room air chamber 70 to the outside air chamber 72 in repeating rotary motion.

Outside air entry openings 74 are defined in the housing at the outside air chamber 72 and permit the entry of outside air for circulation in an outward direction through the lower portion 54 of the outside coil 50.

An outside air subdivision partition 76 underlies the dessicant disk 62 and separates the volume including the disk and communicating with the top coil portion 52 from the remainder of the outside air chamber 72. An opening 78 is formed in partition 76 and is provided with a motor driven fan 80 for selectably providing a flow of outside air from the outside through the top coil portion 52, via the dessicant disk 62 to the remainder of the outside air chamber 72 for circulation through the lower coil portion 54.

A room air subdivision partition 82 separates the room air chamber 70 into a top portion 84 which includes the dessicant disk 62 and a lower portion 86 which includes the inside coil 51 and the blower 58. A damper 88 provides selectable communication between the two portions of the room air chamber 70.

The operation of the apparatus of FIG. 5 is as summarized hereinbelow:

Blower 58 draws air from the room volume through inside coil 51 and returns it to the room. When damper 88 is open, part of the air which has passed through the inside coil 51 also contacts the dessicant. When damper 88 is closed, the room air does not contact the dessicant.

Referring to the outside air flow, it is seen that when fan 60 is in operation and fan 80 is not in operation, outside air is drawn through openings 74 and is forced outwardly through the lower coil portion 54. When both fans 60 and 80 are in operation at the same time, outside air is also drawn through the top coil portion 52 and through the dessicant disk 62. This air is mixed with the air which enters the lower portion of the outside air chamber 72 via openings 74 and is forced outwardly through lower coil portion 54.

It is a particular feature of the present invention that the outside coil is divided into two portions, a top portion 52 communicating with the dessicant disk 62, and a lower portion 54 not communicating with the dessicant disk. The lower coil portion 54 is sized to handle the entire load on the apparatus when operating in a conventional mode, while the top coil portion 52 is sized to handle the air flow required for recharging of the dessicant disk 62 in the non-conventional mode of operation of the apparatus which will be described hereinafter.

The series interconnection of the coils is such that when fan 60 is operating and fan 80 is not operating, all condensing or evaporating of the refrigerant (as the case may be) takes place in the lower coil portion 54. When fan 80 is also in operation, condensing or evaporating takes place in the top portion 52 as well as in the bottom portion.

In accordance with a preferred embodiment of the invention, the lower coil portion 54 is subdivided into a top lower portion 90 and a bottom lower portion 92. A series connection of the portions of the outside coil is preferably as follows for evaporation, for example; liquid refrigerant enters bottom lower portion 92 and begins to evaporate, removing heat from the air stream. The refrigerant then passes to top portion 52. If fan 80 is not in operation, substantially no evaporation takes place since there is no air circulation therethrough and thus no heat source. The refrigerant thus leaves top portion 52 substantially in the same state as it entered and then passes to top lower portion 90 where evaporation is completed.

If fan 80 is in operation, evaporation continues also in top portion 52, evaporation is completed before the refrigerant reaches the end of top lower portion 90, and thus part of the top lower portion 90 is effectively unused. A similar circulation regimen operates for condensation.

It is appreciated that identical operational results can be provided by employing suitable parallel refrigerant connections and solenoid operated valves.

It is a particular feature of the embodiment illustrated in FIG. 5 that collection of condensate on the top coil portion 52 is used to govern the heat exchange operation of the top coil portion. To this end, the top coil portion is constructed to retain condensate thereon. Such construction may take a number of forms. For example, slanted fins may be used in contrast to the conventional vertical fins in order to retard drainage from the coil. Alternatively or additionally ice formation around the top coil portion may be enhanced by using relatively widely spaced fins, as illustrated in FIG. 7.

Alternatively, the controllable limitation of the heat exchange operation of the top coil portion could be provided by suitable refrigerant circuitry and solenoid valves operated in response to an outdoor humidistat.

The various modes of operation of the apparatus of FIG. 5 and more particularly of FIGS. 5–7 will now be described. Conventional heating and cooling modes of operation are realized when blower 58 and fan 60 are in operation, fan 80 and motor 66 are not in operation and damper 88 is closed. The operation is essentially similar to that of an ordinary air conditioner heat pump.

Operation of the apparatus of FIGS. 5–7 in a heating humidifying mode requires the operation of blower 58 and of fans 60 and 80. Motor 66 operates providing rotation of the dessicant disk 62 for regeneration thereof. Typically rotation is at a speed of 1–2 revolutions per hour. Damper 88 is open. Relatively dry ambient outside air, having a relative humidity of less than about 70–80%, is drawn through the top coil portion 52 by fan 80. Since the ambient outside air is dry, little condensate is produced on the top coil portion 52 and its heat transfer characteristics are substantially unaffected. The air passing through top coil portion 52 is cooled thereby, thus raising its relative humidity. The air then enters into contact with the dessicant disk 62 where it gives up moisture and is reheated thereby back to outside ambient temperature. The air then enters the lower portion of the outside air chamber 72 and mixes with the ambient outside air which enters via openings 74. The mixed air is forced outwardly through the lower coil portion 54. Evaporation of the refrigerant takes place in the top coil portion 52 and in the bottom coil portion 54. On the room side, part of the air which is heated by the inside coil 51 passes through open damper 88 and into contact with the dessicant where it picks up moisture and brings it into the room.

In operation of the apparatus in a heating-/humidifying/frost avoidance mode, the arrangements of the apparatus are as specified hereinabove for operation in the heating/humidifying mode. The difference is in that the ambient outside air is relatively humid, i.e. more than 70–80%. This humid air is drawn through the top coil portion 52 producing collection of condensate in the vicinity of the top coil portion. The condensate collection, which may be in liquid or frozen form, reduces the heat transfer between the refrigerant in the top coil portion 52 and the ambient outside air, such that the outside ambient air is only slightly cooled. Thus when this air passes from the top coil portion to the dessicant disk, it is dried and heated to above ambient. This dried heated air enters the lower portion of the outside air chamber 72 and is mixed with the ambient outside air entering via openings 74. This mixed air has a relative humidity which is lower than ambient and therefore frosting at the lower coil portion 54 is reduced. Evaporation of the refrigerant takes place primarily in the lower coil portion 54. The room side circulation is the same as described hereinabove in connection with the heating/humidifying mode.

Operation in the cooling/dehumidifying mode is essentially similar to the operation described hereinabove in connection with the heating/humidifying mode with the following exceptions: The refrigerant circulation is reversed, such that the outside air coil operates as a condenser and the inside air coil operates as an evaporator. Moisture is removed by the dessicant from the room air stream and added to the outside air stream.

Further in accordance with a preferred embodiment of the present invention, there is provided a dehumidifying/reheat mode of operation for summer use. This mode of operation is particularly useful for controlling humidity during high latent and low sensible loads by reheating the supply air to the room after it has passed through the inside coil for cooling thereof. In the apparatus of the present invention illustrated in FIG. 5, operation in the dehumidifying/reheat mode is identical to operation in the cooling/dehumidifying mode except that the dessicant disk is rotated at a relatively fast rate, typically 1–2 revolutions per minute.

In the dehumidifying/reheat mode, fan 80 draws outside ambient air through the top coil portion 52 where it is heated. The air then gives up heat to the rapidly rotating dessicant disk 62. This air is cooled thereby to below ambient. It then mixes with outside ambient air which enters the outside air chamber 72 via openings 74 and is exhausted via the lower coil portion 54. Condensing of the refrigerant takes place in both the top and lower coil portions 52 and 54 respectively. The heated portion of disk 62 rotates into the path of the room supply air that has passed through damper 88 for heating of this air. In this mode of operation, control of the compressor can be in response to a humidistat as is the case in ordinary stand alone household dehumidifying units.

It will be appreciated by persons skilled in the art that the present invention is not limited to what has been particularly shown and described hereinabove. Rather the scope of the present invention is only defined in the claims which follow:

I claim:

1. A temperature and humidity control system comprising:

a heat pump including a compressor, an inside air coil and an outside air coil;

vaporizable refrigerant contained in a closed conduit communicating with said compressor, said inside air coil and said outside air coil;

a regeneratable dessicant material;

valve and conduit means for selectably directing air into and communicating with said inside air coil, said outside air coil and said dessicant material, said valve and conduit means comprising:

first means operable in a cooling/dehumidifying mode for supplying inside air first to said inside air coil and from said inside air coil to said dessicant material, and from said dessicant material to a volume sought to be conditioned;

second means operable in a heating/humidifying mode for supplying air first to said inside air coil and from said inside air coil to said dessicant material for humidifying of said air and thence to a volume sought to be conditioned;

third means operable in said cooling/dehumidifying mode for supplying outside air first to said outside air coil and from said outside air coil to said dessicant material for dehumidifying said dessicant material;

fourth means operable in said heating/humidifying mode for supplying outside air first to said outside air coil and from said outside air coil to said dessicant material for regenerating said dessicant material; and fifth means operative in a heating/humidifying/frost avoidance mode causing outside air to communicate first with said dessicant material and thence with said outside air coil.

2. A system according to claim 1 and wherein said outside air coil comprises first and second coil portions interconnected in series for refrigerant flow therethrough, said first coil portion being arranged for operation for engaging outside air, and passing said air to said dessicant material.

3. A system according to claim 2 and wherein said first coil portion is arranged for retention of condensate in the vicinity thereof, whereby collected condensate reduces the heat transfer characteristics of the coil portion to the outside air passing therethrough as a function of the humidity of the outside air.

4. A system according to claim 1 and wherein said dessicant material is arranged in the form of a rotating body which sequentially engages air passing through said inside air coil and air passing through said outside air coil, for providing a repeating dessicant regeneration cycle.

5. A system according to claim 4 and wherein said rotating body is rotated at a speed sufficient to produce heat transfer in said dessicant from air passing the outside air coil to air passing the inside air coil, for providing dehumidifying/reheat operation.

6. A method for providing temperature and humidity control to a volume comprising:

cooling/dehumidifying mode operation including the steps of feeding warm moist inside air first to an inside air coil of a heating pump, thence to a dessicant material and thence to the volume sought to be conditioned and supplying outside air first to said outside air coil and from said outside air coil to said dessicant material for dehumidifying said dessicant material;

heating/humidifying mode operation including the steps of supplying inside air first to said inside air coil for heating of said air, and from said inside air coil to said dessicant material for humidifying of said air and thence to a volume sought to be conditioned and supplying outside air first to said outside air coil and from said outside air coil to said dessicant material for regenerating said dessicant material; and heating/humidifying/frost avoidance operation including the steps of supplying inside air first to said inside air coil for heating of said air, and from said inside air coil to said dessicant material for humidifying of said air and thence to a volume sought to be conditioned and causing outside air to communicate first with said dessicant material and thence with said outside air coil.

* * * * *